US009929513B2

(12) United States Patent
Wang

(10) Patent No.: US 9,929,513 B2
(45) Date of Patent: Mar. 27, 2018

(54) ELECTRICAL CONNECTOR WITH METALLIC SHIELDING PLATE UNITARILY FORMED WITH VERTICLA BOARD

(71) Applicant: FOXCONN INTERCONNECT TECHNOLOGY LIMITED, Grand Cayman (KY)

(72) Inventor: Yong-Qi Wang, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/411,966

(22) Filed: Jan. 21, 2017

(65) Prior Publication Data

US 2017/0222372 A1 Aug. 3, 2017

(30) Foreign Application Priority Data

Feb. 1, 2016 (CN) ..... 2016 1 0068035

(51) Int. Cl.

| | |
|---|---|
| ***H01R 13/648*** | (2006.01) |
| ***H01R 13/6591*** | (2011.01) |
| ***H01R 13/405*** | (2006.01) |
| ***H01R 13/502*** | (2006.01) |

(52) U.S. Cl.

CPC ..... *H01R 13/6591* (2013.01); *H01R 13/405* (2013.01); *H01R 13/5025* (2013.01)

(58) Field of Classification Search

CPC ..... H01R 13/648; H01R 13/6581; H01R 13/658; H01R 13/6586; H01R 13/6585

USPC ..... 439/607.01, 607.05, 607.08, 660

See application file for complete search history.

(56) References Cited

U.S. PATENT DOCUMENTS

| | | | | |
|---|---|---|---|---|
| 9,761,995 | B2 * | 9/2017 | Little | H01R 13/6215 |
| 2014/0073184 | A1 * | 3/2014 | Zhao | H01R 13/6594 439/607.55 |
| 2015/0295362 | A1 * | 10/2015 | Tziviskos | H01R 13/6581 439/607.01 |
| 2016/0141806 | A1 * | 5/2016 | Guo | H01R 13/504 439/607.01 |

FOREIGN PATENT DOCUMENTS

| | | |
|---|---|---|
| CN | 204156224 | 2/2015 |
| CN | 204230555 | 3/2015 |
| CN | 204257908 | 4/2015 |
| CN | 204947243 | 1/2016 |

* cited by examiner

*Primary Examiner* — Abdullah Riyami
*Assistant Examiner* — Thang Nguyen
(74) *Attorney, Agent, or Firm* — Wei Te Chung; Ming Chieh Chang

(57) ABSTRACT

An electrical connector includes a terminal module enclosed within a metallic shield wherein the terminal module includes an insulative housing with two rows of contacts and a metallic shielding plate therebetween. The terminal module includes a rear portion and a front portion extending forwardly from the rear portion. The shield includes a stopping wall with an opening extending therethrough in a front-to-back direction so that the rear portion of the terminal module abuts against the stopping wall while the front portion of the terminal module extends through the opening forwardly.

19 Claims, 14 Drawing Sheets

ELECTRICAL CONNECTOR WITH METALLIC SHIELDING PLATE UNITARILY FORMED WITH VERTICLA BOARD

BACKGROUND OF THE INVENTION

1. Field of the Invention

The present invention relates to an electrical connector, and particularly to the electrical connector having a metallic shielding plate unitarily formed with a vertical wall which is secured to a metallic shield.

2. Description of Related Art

The Chinese Patent No. CN204230555 and CN204257908 disclose the upper terminal module and the lower terminal module sandwiching a metallic shielding plate therebetween in the vertical direction and successively commonly assembled within the metallic shield. Anyhow, such an arrangement tends to be tilted during assembling, thus losing the true positions therebetween.

Therefore, it is desired to have an electrical connector without such drawback.

SUMMARY OF THE INVENTION

An electrical connector includes a terminal module enclosed within a metallic shield wherein the terminal module includes an insulative housing with two rows of contacts and a metallic shielding plate therebetween. The terminal module includes a rear portion and a front portion extending forwardly from the rear portion. The shield includes a stopping wall with an opening extending therethrough in a front-to-back direction so that the rear portion of the terminal module abuts against the stopping wall while the front portion of the terminal module extends through the opening forwardly. One of the rear portions of the terminal module and the stopping wall includes a plurality of protruding alignment post and the other includes a plurality of alignment grooves to receive the alignment post. The metallic piece includes a main board and a supporting part embedded within the insulative housing. The alignment posts are formed on the main board and the alignment grooves are formed in the stopping wall. The main board extends vertically and the middle portion of the main board forms an opening through which the housing extends. The metallic piece further includes a tubular section outside of the supporting part and enclosing the insulative housing. The contact includes a solder section located upon the corresponding platform located behind the main board. The platform forms a guiding groove, and a sealing part seals spaces between the metallic piece and the metallic shield. The alignment grooves are located by two sides of the opening, and the opening is smaller than the front opening and the rear opening of the metallic shield.

Compared with the prior arts, during mating the inserted plug may abut against the main board and imposes forces thereupon, thus preventing direct impact upon the terminal module. In addition, the cooperation of the alignment posts and the corresponding alignment grooves may assure the correct positions among the insulative housing, the contacts and the metallic piece within the metallic shield.

Other objects, advantages and novel features of the invention will become more apparent from the following detailed description when taken in conjunction with the accompanying drawings.

DETAILED DESCRIPTION OF THE PREFERRED EMBODIMENT

Figure 1:
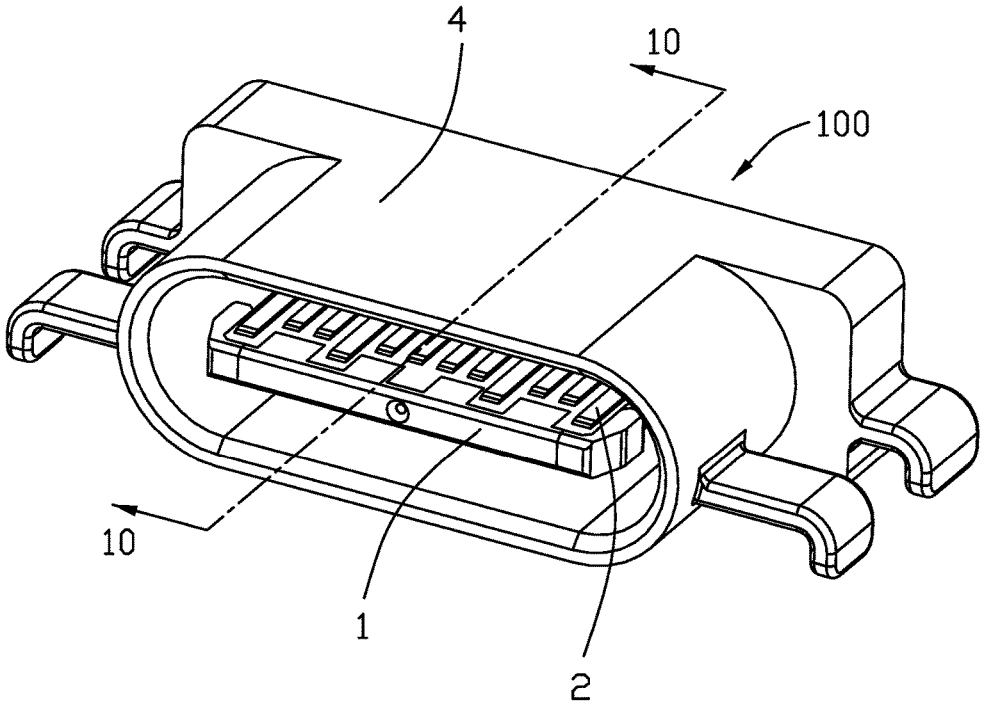
FIG. 1 is a perspective view of the electrical connector according to the presently preferred embodiment of the invention.
Figure 2:
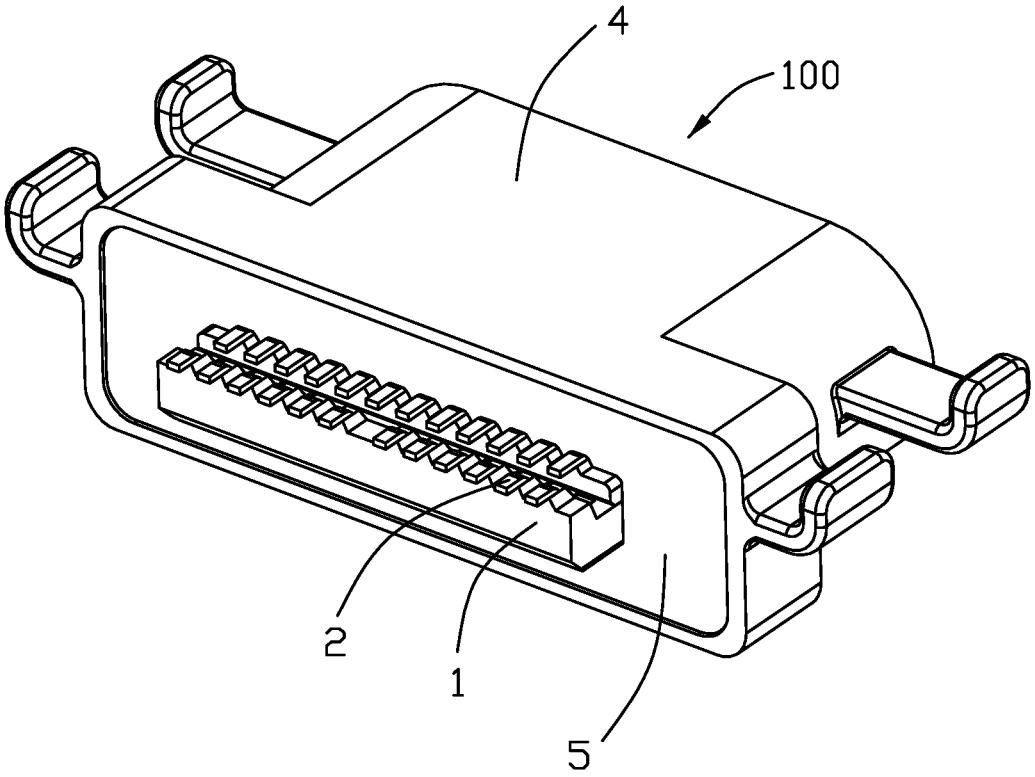
FIG. 2 is another perspective view of the electrical connector of FIG. 1.
Figure 3:
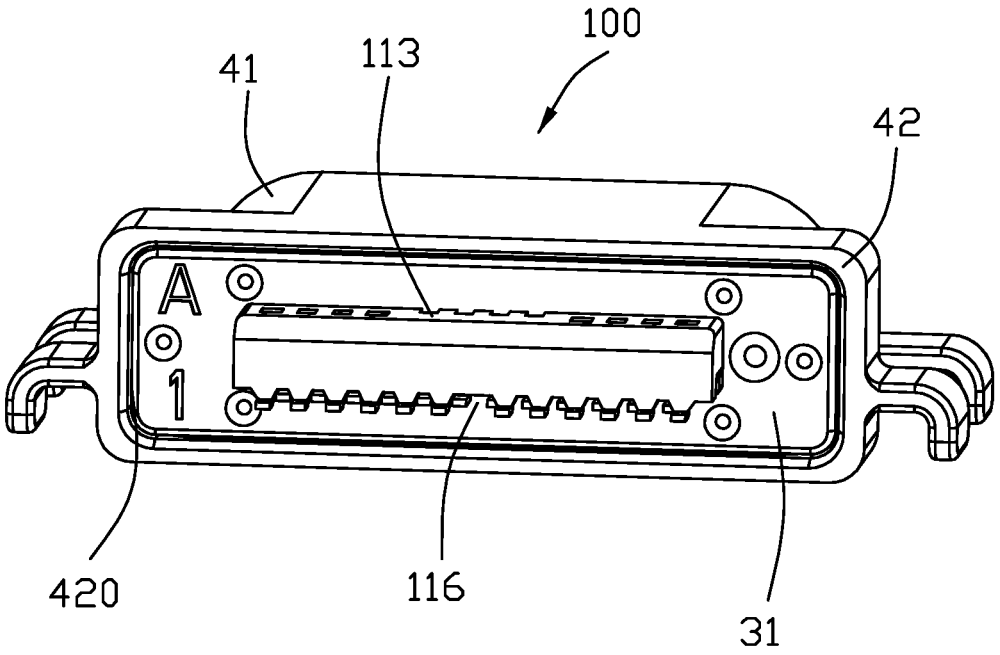
FIG. 3 is a perspective view of the electrical connector without the dust cover.
Figure 4:
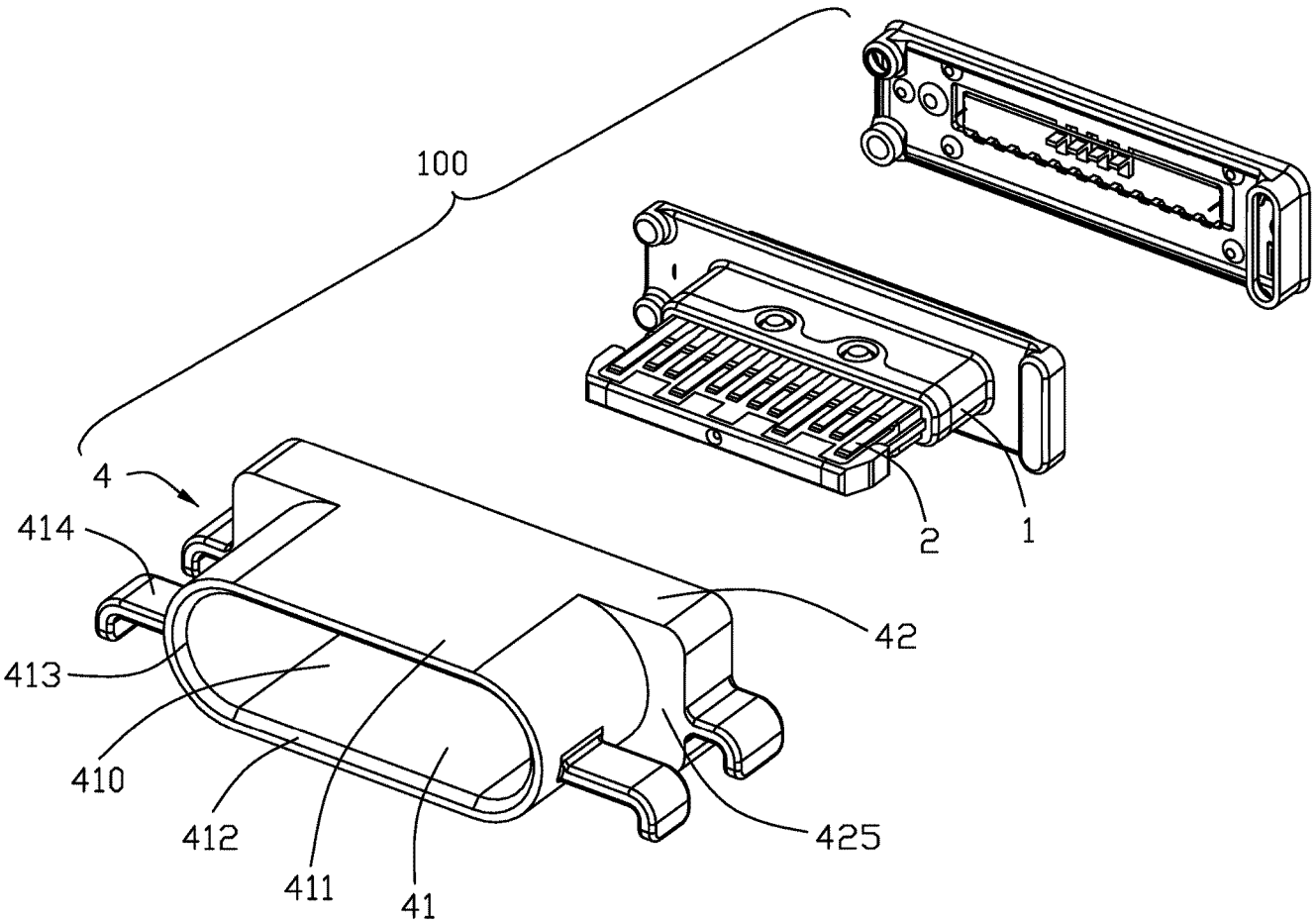
FIG. 4 is an exploded perspective view of the electrical connector of FIG. 1.
Figure 5:
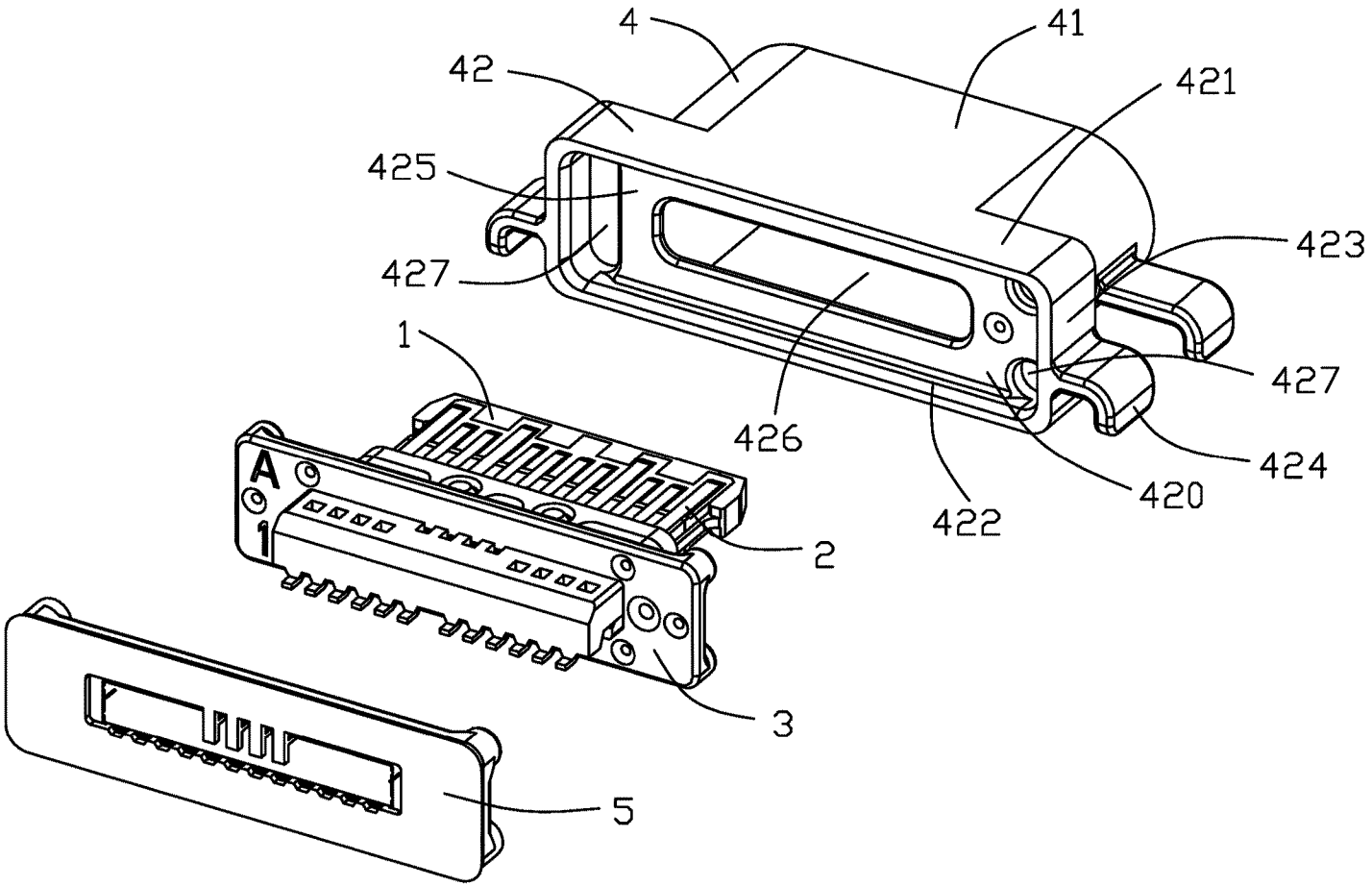
FIG. 5 is another exploded perspective view of the electrical connector of FIG. 5.
Figure 6:
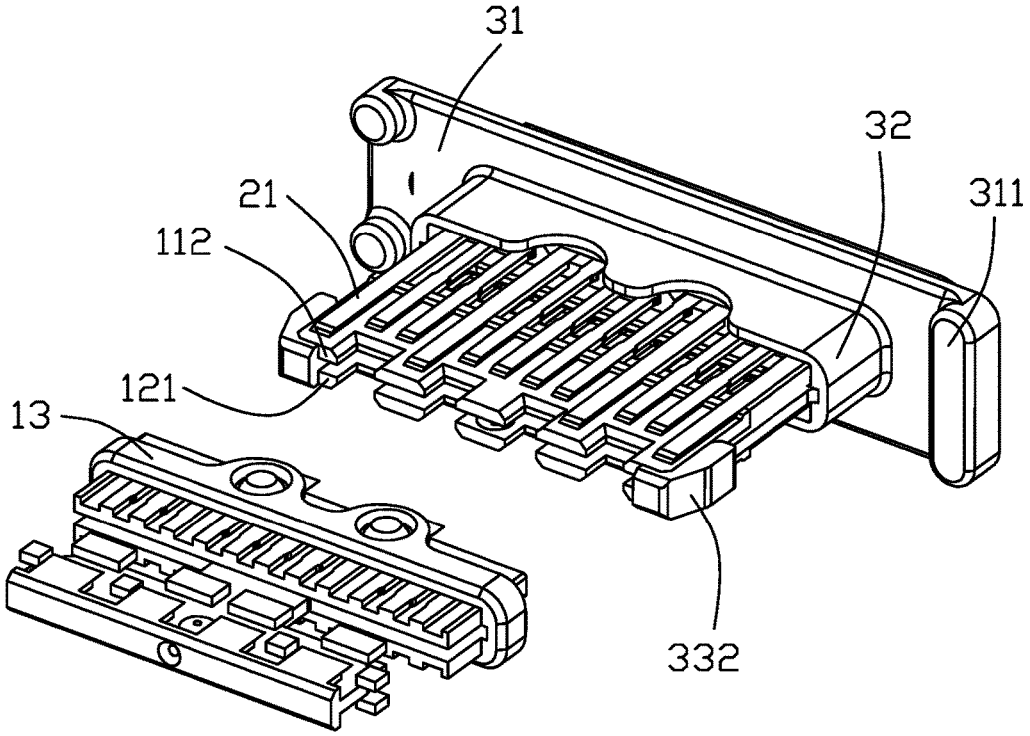
FIG. 6 is an exploded perspective view of the electrical connector of FIG. 1 where the metallic shield is removed therefrom.
Figure 7:
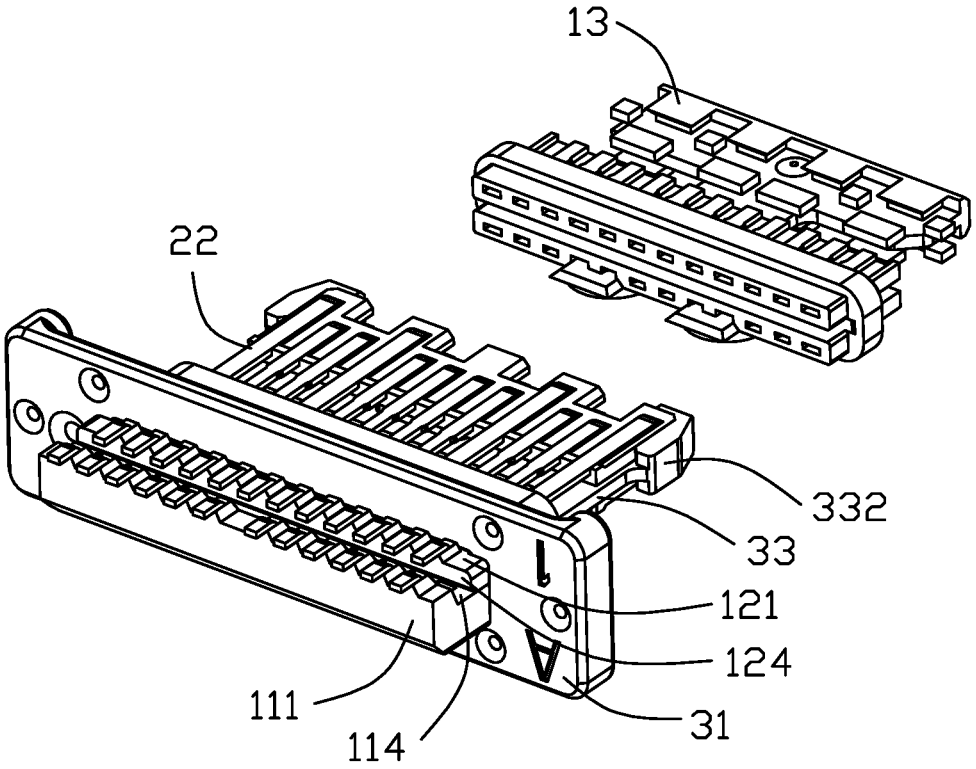
FIG. 7 is another exploded perspective view of the electrical connector of FIG. 6.
Figure 8:
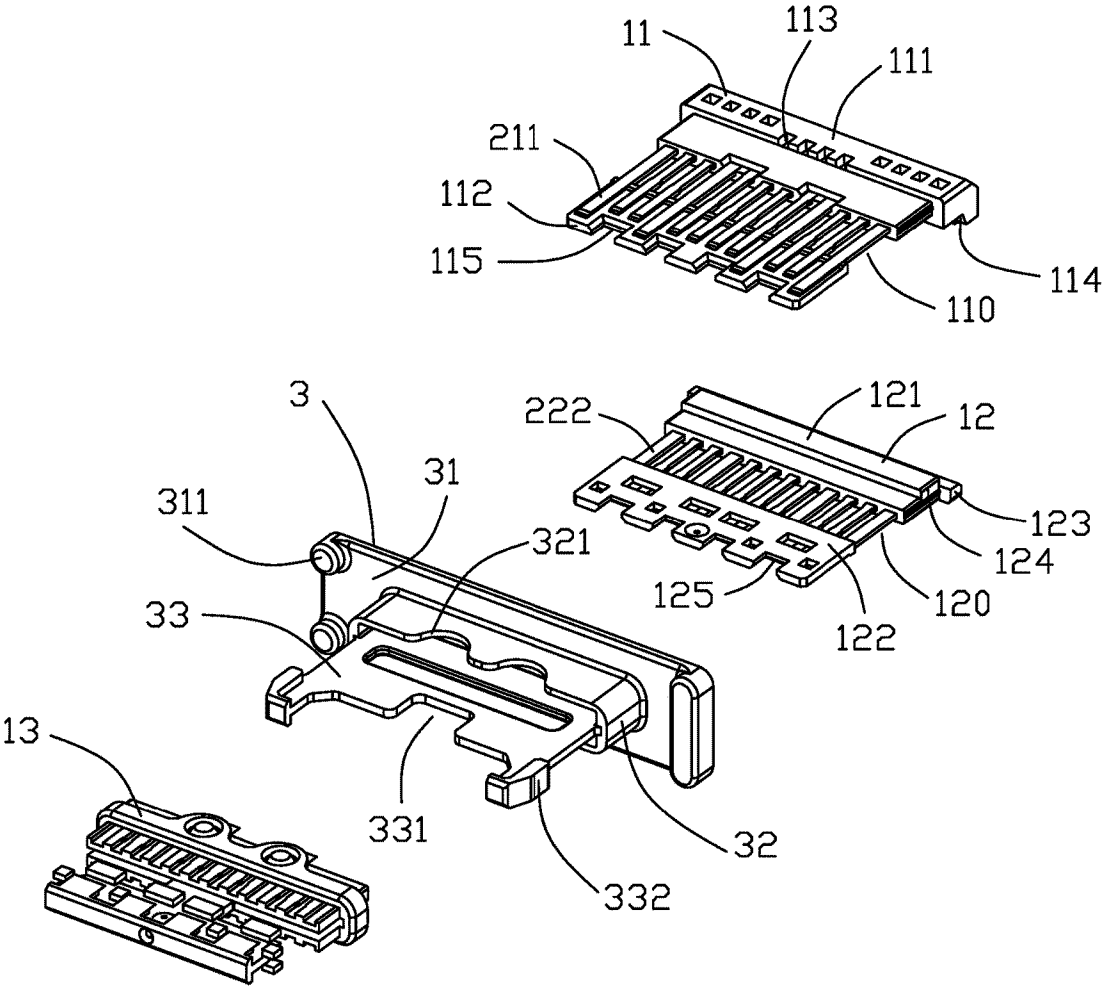
FIG. 8 is a further exploded perspective view of the electrical connector of FIG. 6.
Figure 9:
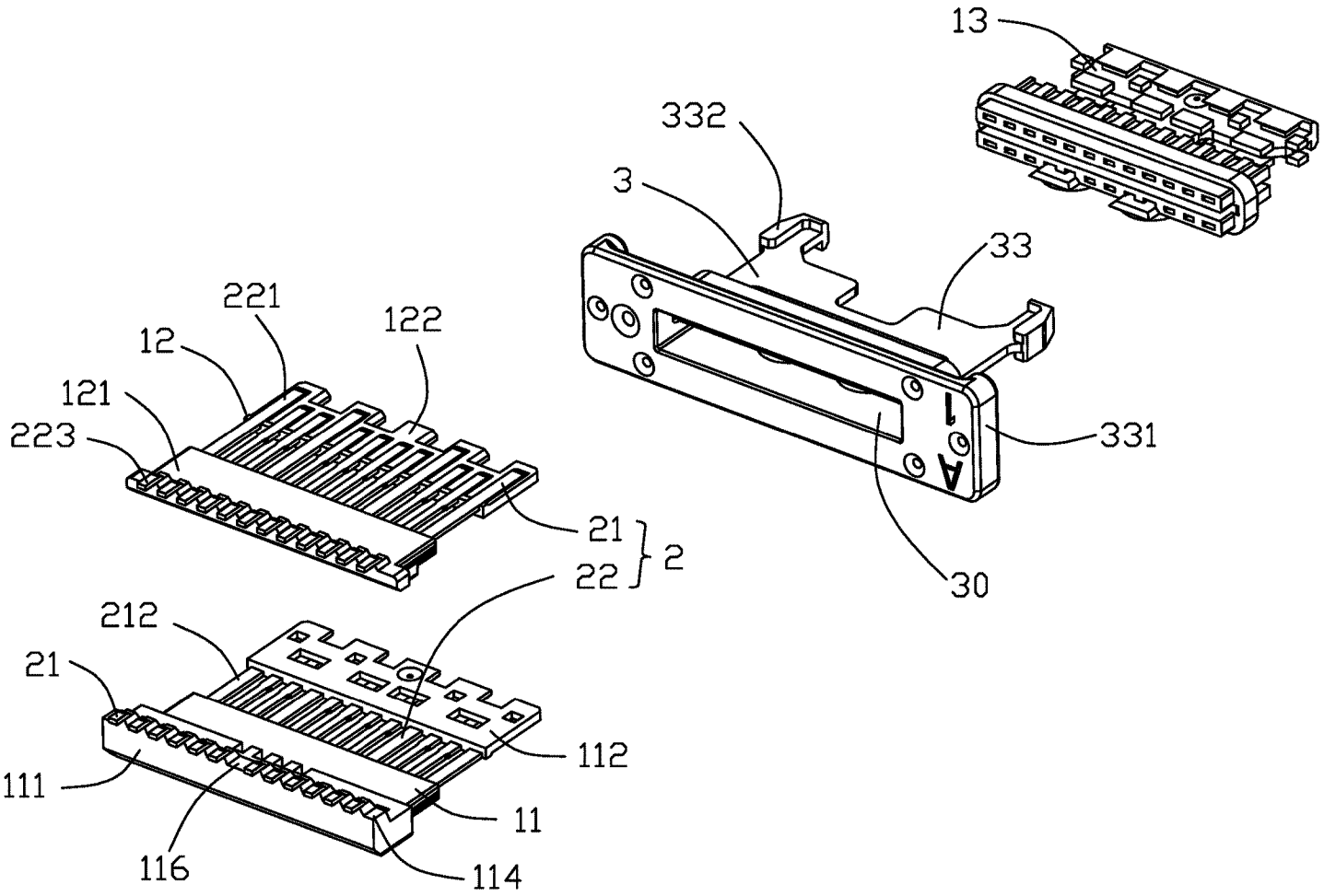
FIG. 9 is a further exploded perspective view of the electrical connector of FIG. 7.
Figure 10:
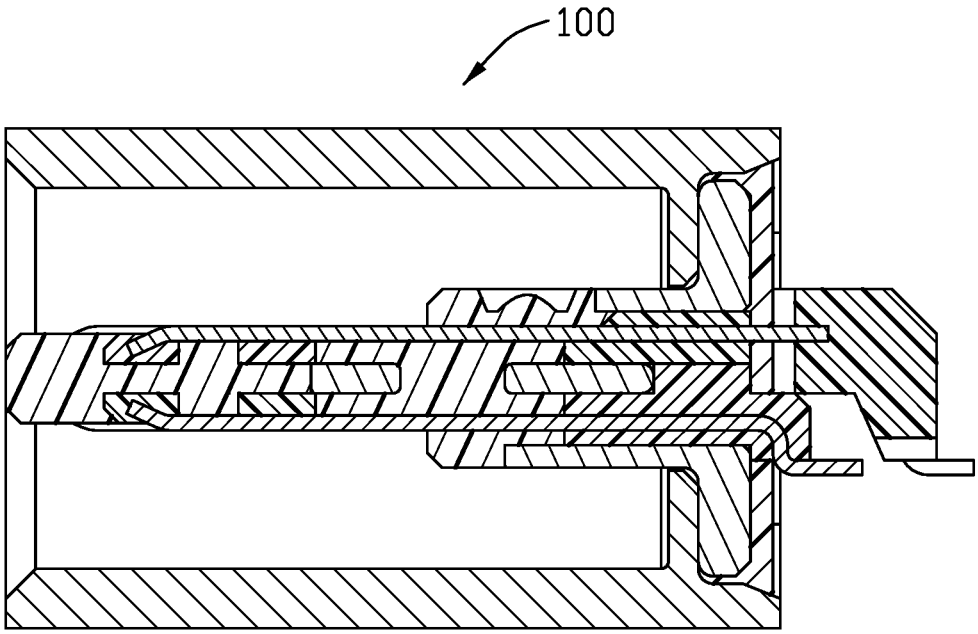
FIG. 10 is a cross-sectional view of the electrical connector of FIG. 1.

Reference will now be made in detail to the preferred embodiment of the present invention. Referring to FIGS. 1-10, in the first embodiment an electrical connector 100 includes an insulative housing 1, a plurality of contacts retained in the housing 1, a metallic piece 3 partially embedded within the housing 1, a metallic shield 4 and a sealing member 4 at a rear end of the housing 1. The metallic shield 4 defines a mating end to communicate with an exterior in a front-to-back direction which is perpendicular to a transverse direction and a vertical direction.

The insulative housing 1 includes a first insulator 11, a second insulator 12 and a third insulator 13. The first insulator 11 and the second insulator 12 are of a plate. The first insulator 11 includes a first base 111 and a first tongue 112 spaced from the first base 111 via a first space 110. The first base 111 forms guiding grooves 113. The first base 11 forms a platform 114 with recesses 116. The first tongue 112 forms a plurality of first apertures 115.

The second insulator 12 includes a second base 121 and a second tongue 122 spaced from the second base 121 with a second space 120. The contacts 2 are exposed in the first space 110 and the second space 120. The second base 121 has protrusions 123 on two opposite ends of the rear portion, and the step 124 coupled with the platform 114. The front end of the second tongue 12 forms a plurality of second apertures 125.

The third insulator 13 encloses the first insulator 11 and the second insulator 12 including the first space 110, the second space 120, the first apertures 115 and the second apertures 125. The contacts include the first contacts 21 retained on the first insulator 11, and the second contacts 22 retained on the second insulator 12. The first contact 21 includes the first contacting section 211 exposed and retained on the (upper) surface of the first tongue 112, the first retaining section hung in the first space 110, and a first soldering section 213 exposed outside of the insulator 1. The second contact 22 includes the second contacting section 221 exposed upon an under surface of the second tongue 122, the second retaining section 222 hung in the second space 120, and a second soldering section 223 exposed outside of the housing 1. The second soldering sections 223 are respectively located by on the step 124. The first soldering sections 213 and the second soldering sections 223 arranged in two rows in the same plane.

The first contacts 21 and the second contacts 22 are symmetrically arrange with each other with regard to a centerline, and include four power/ground contacts and eight signal contacts wherein the four power/ground contacts extend forwardly further than the signal contacts. In the four power/grounding contacts, the outer two contacts are used for grounding and the inner two contacts are used for power. In the eight contacts, the four high speed differential pair contacts, a pair of lower speed differential pair contacts, and two detecting contacts by two sides of the low speed differential pair contacts. The first contacting sections 211 of the first contacts 21 and the second contacting sections 221 of the second contacts 22 are symmetric with each other in the vertical direction. The first soldering sections 213 of the first contacts 21 and the second soldering sections 223 of the second contacts 22 are located in a same plane. Therefore, disregarding the insertion orientations of the plug connector (not shown), the first contacting sections 211 and the second contacting sections 221 are always mated with the plug connector correctly.

The metallic piece 3 includes a vertically extending main board 31, a tubular section 32 extending from the main board 31, and a supporting part 33 extending forwardly from an interior of the tubular section 32. The main board 31 is rectangular with an opening 30 extending there through via the tubular section 32. The main board 31 includes a plurality of alignment posts 311 close to the supporting part 33 and located around the four corners of the main board 31 or at two lateral sides in an oval configuration. The tubular section 32 encloses the supporting part 33 which is located at a middle level thereof, wherein the upper edge and the lower edge of the tubular section 31 forms a plurality of curved cutouts. The metallic piece 3 includes a third aperture 331, and a covering portion 332 is formed at two opposite sides of the third aperture 331. Notably, the supporting part 32 forms a pair of locking notched structures (not labeled) on two opposite lateral sides for engagement with corresponding latches of the mated plug connector (not shown).

The first insulator 11 and the second insulator 12 are respectively located on two opposite surfaces of the supporting part 33, and portions of the first insulator 11 and the second insulator 12 are received within the tubular section 31. The covering portion 332 of the metallic piece 3 covers the first tongue 112 of the first insulator 11 and the second tongue 122 of the second insulator 12. A rear portion of the first base 111 of the first insulator 11 and that of the second base 121 of the second insulator 12 extend through the tubular section 32 to be exposed upon a rear side of the main board 31.

The metallic shield 4 includes a round tubular section 41 and a rectangular restriction section 42 behind the round tubular section 41. The round tubular section 41 has a cross-section of a racehorse track, including opposite top wall 411 and bottom wall 412 and the arced side walls 413 to commonly form a first receiving cavity 410. The arced wall 413 includes an outward and downward extending first leg 414. The restriction section 42 is of a rectangular configuration, including opposite upper wall 421 and lower wall 422 and a pair of side walls 423 betweenthe upper wall 421 and the lower wall 422. The upper wall 421, the lower wall 422 and the side walls 423 commonly form a second receiving space 420. The upper wall 421 is connected with the top wall 411, the lower wall 422 is connected with the bottom wall 412. The side wall 423 forms the corresponding outwardly and downwardly extending second leg 424. A front opening of the tubular section 41 is defined as the front mating end, a rear opening of the restriction section 42 is defined as the rear connecting end. A boundary of the tubular section 41 and the restriction section 42 forms a stopping wall 425 with a significant thickness thereof to separate the first receiving space 410 and the second receiving space 420. The stopping wall 425 forms an opening 426 smaller than the front mating end. The stopping wall 425 has the alignment grooves 427 on two sides corresponding to and receiving the alignment posts 311 of the metallic piece 3. Alternately, the alignment groove 427 may be formed in the metallic piece 3 and the alignment posts are formed on the stopping wall 425.

A combination of the insulative housing 1, the contacts and the metallic piece 3 is assembled in the metallic shield 4 wherein both the first insulator 11 and the second insulator 12 extend through the opening 426, and the first base 111 of the first insulator 11 and the second base 121 of the second insulator 12 forwardly abut against the stopping wall 425. The alignment posts 311 of the metallic piece 3 are received within the alignment grooves 427 of the metallic shield 4, thus assuring the true positions among those corresponding parts. The shield 4 and the main board 31 may be welded together in addition to the retention between the alignment posts 311 within the alignment grooves 427. The rear portions of the first base 111 and the second base 121 are received within the second receiving space 420 having gaps with regard to the restriction section 42. The glue fills the second receiving space 420 and enters the gaps through the guiding groove 113 and the recess 115 to form a sealing member 5.

Figure 11:
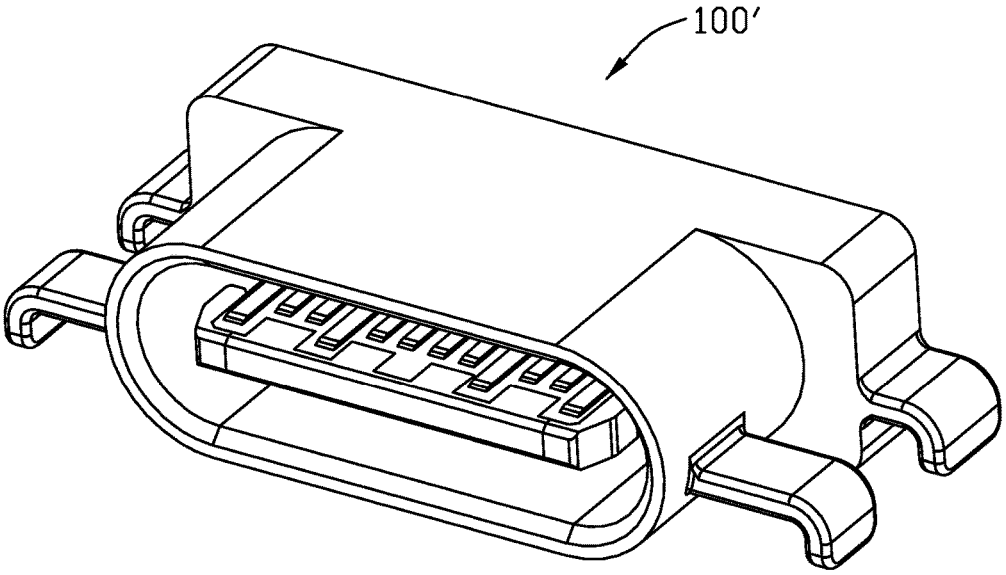
FIG. 11 is a perspective view of the electrical connector according to another embodiment.
Figure 12:
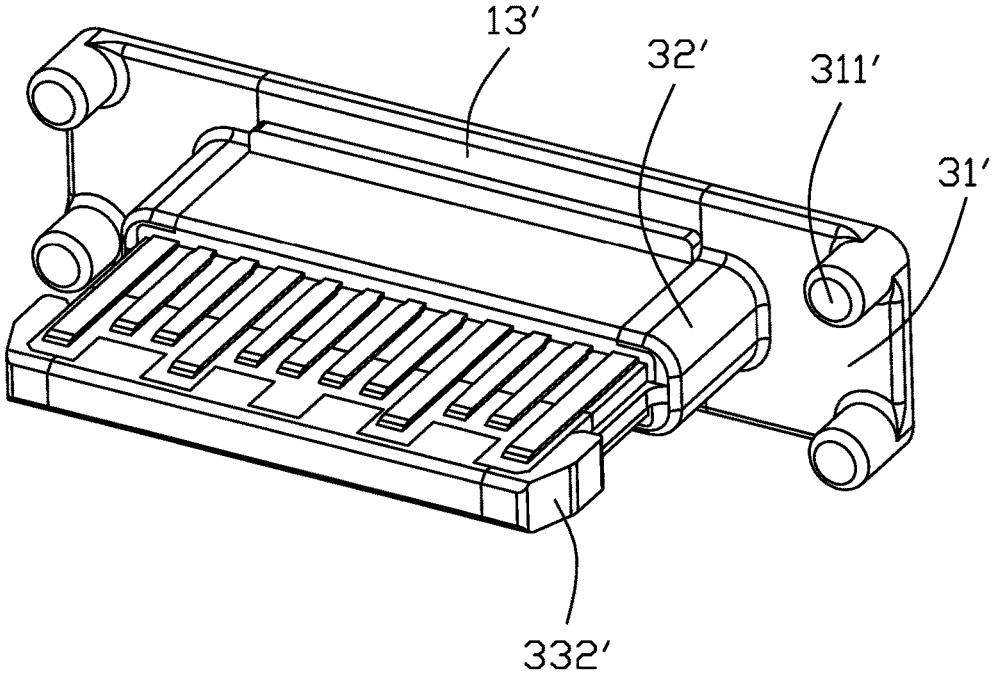
FIG. 12 is a perspective view of the electrical connector of FIG. 10 without the metallic shield.
Figure 13:
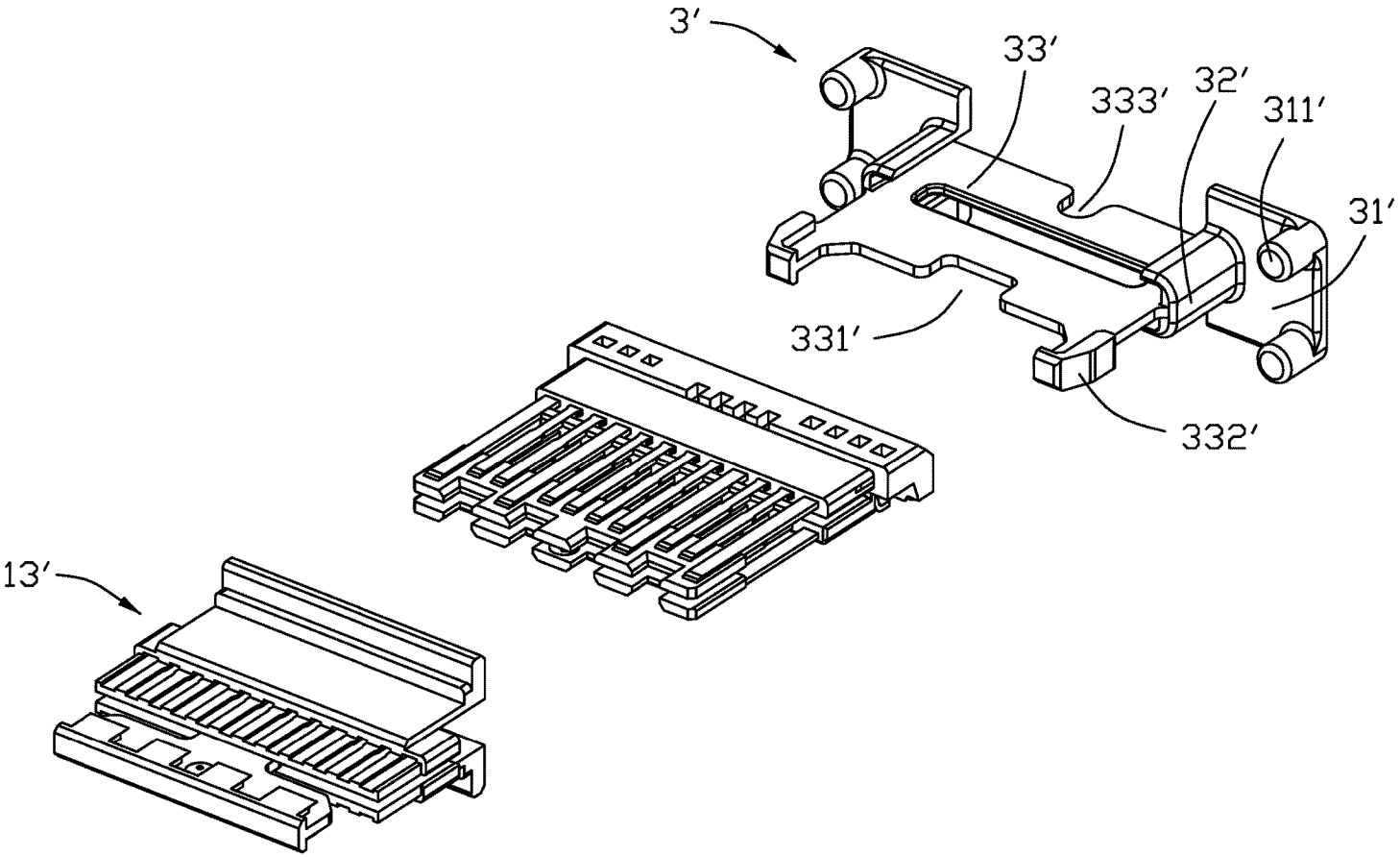
FIG. 13 is a further exploded perspective view of the electrical connector of FIG. 12.
Figure 14:
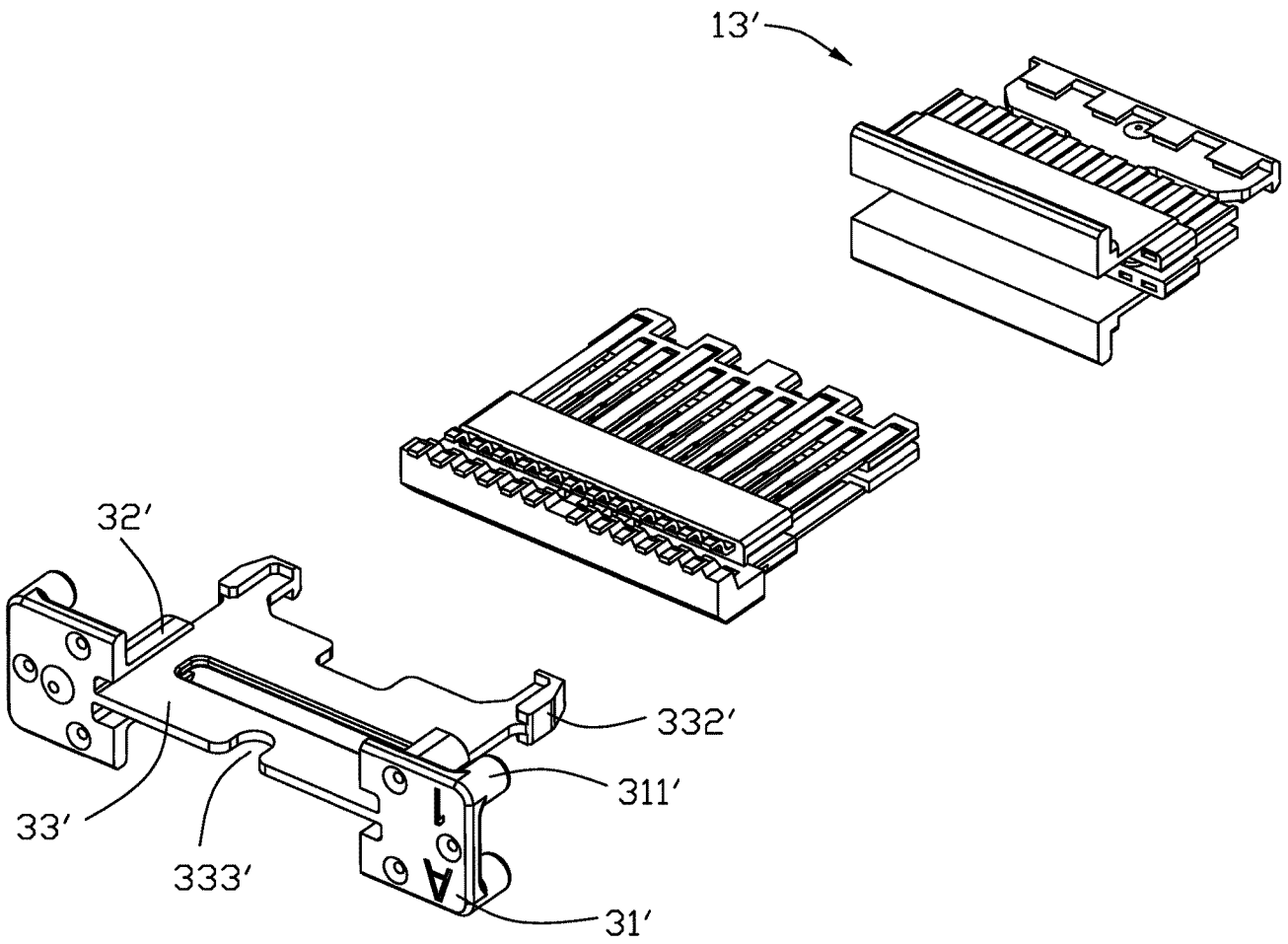
FIG. 14 is another exploded perspective view of the electrical connector of FIG. 13.

Referring to FIGS. 11-14, the electrical connector 100' is similar to the electrical connector 100 of the first embodiment. The corresponding metallic piece 3' includes a main board 31', a tubular section 32' unitarily extending from the main board 31', and a forwardly extending supporting part 33' in the tubular section 32'. The main board 31' has some cutouts. The main board 31' forms a plurality of alignment posts 311' around four corners. The tubular section 32' encloses two sides of the supporting part 33' with cutouts. The tubular section 32' extends through the main board 31'. The third insulator 13' encloses the main board 31' and the cutouts of the tubular section 32'. The supporting part 33' is attached to two side wall of the tubular section 32' with a rear end flush with the main board 31'. The supporting part 33' forms apertures 331' and a covering portion 332'. The supporting part 33' forms a hole 333' corresponding to the guiding groove 113 and the recess 116.

The insulative housing 1, the two rows of contacts 2 and the metallic piece 3 commonly form a terminal module. The terminal module includes a rear portion abutting against the rear face of stopping wall 425, and a front portion extending through the opening 426. During mating, the mated plug connector (not shown) abuts against the front face of the stopping wall 425 so as to apply the corresponding to the stopping wall 425 rather than to the terminal module, thus protecting the contacts 2. Moreover, the alignment posts 311 of the metallic piece 3 are received within the corresponding alignment grooves 427 of the metallic shield 4, thus assuring the true position of the terminal module in the metallic shield 4 without tilting.

However, the disclosure is illustrative only, changes may be made in detail, especially in matter of shape, size, and arrangement of sections within the principles of the invention.

What is claimed is:

1. An electrical connector comprising: a metallic shield including a stopping wall to separate a front receiving space and a rear receiving space in a front-to-back direction, an opening formed in the stopping wall; and a terminal module assembled within the metallic shield and including two rows of contacts insert-molded within an insulative housing associated with a metallic piece; wherein the metallic piece includes a vertical main board forwardly abutting against the stopping wall, and a supporting part extending in horizontal plane defined by said front-to-back direction and a transverse direction perpendicular to said front-to-back direction, said supporting part separating said two rows of contacts in a vertical direction perpendicular to both said front-to-back direction and said transverse direction.

2. The electrical connector as claimed in claim 1, further including means for aligning the metallic piece with the stopping wall.

3. The electrical connector as claimed in claim 2, wherein said means includes an alignment post on the main board and an alignment groove in the stopping wall.

4. The electrical connector as claimed in claim 1, wherein said terminal module includes a first terminal module having a first insulator with a plurality of first contacts, a second terminal module having a second insulator with a plurality of second contacts, and the supporting part sandwiched therebetween and commonly integrally formed with a third insulator.

5. The electrical connector as claimed in claim 1, wherein said main board forms an opening through which the insulative housing extends to form a tongue on which contacting sections of the contacts are exposed in the vertical direction.

6. The electrical connector as claimed in claim 5, wherein the opening of the stopping wall is larger than the opening of the main board.

7. The electrical connector as claimed in claim 6, wherein said metallic piece forms a tubular section between the main board and the supporting part, said tubular is aligned with the opening of the main board in the front-to-back direction and received within the opening of the stopping wall.

8. The electrical connector as claimed in claim 5, wherein said insulative housing has a base forwardly abutting against the main board.

9. The electrical connector as claimed in claim 1, wherein an insulative sealing member is applied behind the main board and enters into gaps between the stopping wall and the main board in said front-to-back direction.

10. An electrical connector comprising: a metallic shield having a front tubular section having a cross-section of a horserace track configuration, and a rear rectangular section; a terminal module assembled into the shield and including an insulative housing insert-molded with two rows of contacts and further with a metallic piece having a vertical main board and a horizontal supporting part sandwiched between two rows of contacts in a vertical direction; wherein the vertical main board is fixed to the metallic shield; and wherein said metallic piece further includes a tubular section linked between the main board and the supporting part, a rear portion of said supporting part being located within the tubular section.

11. The electrical connector as claimed in claim 10, wherein the main board forms there through an opening in alignment with the tubular section in the front-to-back direction, and the insulative housing extends through the tubular section with a rear base forwardly abutting against a back surface of the main board around said opening.

12. The electrical connector as claimed in claim 10, wherein said shield further includes a stopping wall against which the main board forwardly abuts.

13. The electrical connector as claimed in claim 12, wherein said metallic piece further includes a tubular section linked between the main board and the supporting part, a rear portion of said supporting part being located within the tubular section.

14. The electrical connector as claimed in claim 13, wherein the main board forms therethrough an opening in alignment with the tubular section in the front-to-back direction, and the insulative housing extends through the tubular section with a rear base forwardly abutting against a back surface of the main board around said opening.

15. The electrical connector as claimed in claim 13, wherein said stopping wall defines another opening therethrough in the front-to-back direction, and said opening is dimensioned to allow the tubular section to extend therethrough in the front-to-back direction.

16. The electrical connector as claimed in claim 15, wherein said another opening in the stopping wall is larger than the opening in the main board.

17. The electrical connector as claimed in claim 12, further including means for aligning the main board with the stopping wall in the front-to-back direction.

18. The electrical connector as claimed in claim 17, wherein said means includes an alignment post formed on one of said stopping wall and said main board, and an alignment groove formed in the other of said stopping wall and said main board.

19. The electrical connector as claimed in claim 12, further including a sealing member filling gaps between the main board and the stopping wall in said front-to-back direction.

* * * * *